United States Patent [19]

Lange, Jr.

[11] 4,146,568

[45] Mar. 27, 1979

[54] PROCESS FOR REDUCING RADIOACTIVE CONTAMINATION IN WASTE PRODUCT GYPSUM

[75] Inventor: Paul H. Lange, Jr., New Haven, Conn.

[73] Assignee: Olin Corporation, New Haven, Conn.

[21] Appl. No.: 821,026

[22] Filed: Aug. 1, 1977

[51] Int. Cl.[2] ..... G21F 9/28

[52] U.S. Cl. ..... 423/170; 252/301.1 R; 252/301.1 W; 423/2; 423/555

[58] Field of Search ..... 252/301.1 W, 301.1 R; 423/2, 20, 170, 555

[56] References Cited

U.S. PATENT DOCUMENTS 3,949,047 4/1976 Cherdron et al. ..... 423/2

FOREIGN PATENT DOCUMENTS 1394734 5/1975 United Kingdom.

*Primary Examiner*—Benjamin R. Padgett
*Assistant Examiner*—Deborah L. Kyle
*Attorney, Agent, or Firm*—Donald F. Clements; James B. Haglind

[57] ABSTRACT

A process for reducing the radioactive contamination in waste product gypsum in which waste product gypsum is reacted with a dilute sulfuric acid containing barium sulfate to form an acid slurry at an elevated temperature, the slurry is preferably cooled, the acid component is separated from the solid, and the resulting solid is separated into a fine fraction and a coarse fraction. The fine fraction predominates in barium sulfate and radioactive contamination. The coarse fraction predominates in a purified gypsum product of reduced radioactive contamination.

18 Claims, No Drawings

PROCESS FOR REDUCING RADIOACTIVE CONTAMINATION IN WASTE PRODUCT GYPSUM

This invention relates to a process for reducing the radioactive contamination in waste product gypsum.

In numerous industries, such as the fertilizer industry, substantial amounts of waste product gypsum are produced by the reaction of phosphate rock with sulfuric acid. In addition, waste product gypsum precipitates from various process streams in such fertilizer processes, and in other processes in which wet process phosphoric acid is used as a reactant. Numerous attempts have been made in the past to purify such waste product gypsum in order to permit its use in other industries, such as in the preparation of wallboard and other construction materials. One of the problems inherent in such proposals is the pressure of radioactive contaminants in the waste product gypsum, which makes its use in the construction of homes and other confined spaces detrimental to inhabitants thereof.

British Pat. No. 1,394,734, discloses that the radioactive contaminants of waste product gypsum are present in the fine fraction and has proposed that waste product gypsum be slurried and processed through a hydrocyclone to separate the waste product gypsum into a coarse fraction and a fine fraction. The radioactive contaminants predominate in the fine fraction and a purified gypsum predominates in the coarse fraction. One of the problems inherent in this proposed process is that there is an insufficient reduction in the radioactive contamination of the gypsum in the coarse fraction to permit its use in wallboard and other construction materials.

There is need at the present time to provide an improved process for reducing the radioactive contaminants in waste product gypsum.

It is a primary object of this invention to provide an improved process for reducing the radioactive contaminants in waste product gypsum. It is a further object of this invention to provide a coarse purified gypsum product from waste product gypsum containing radioactive contaminants.

These and other objects of the invention will be apparent from the following description of the invention.

It has now been discovered that the foregoing objects are accomplished for reducing the radioactive contamination in waste product gypsum in a process which comprises:

(a) admixing waste product gypsum containing radioactive contamination with dilute sulfuric acid containing barium sulfate at an elevated temperature to form an acid slurry, having a solid component comprised of a fine fraction and a coarse fraction, and (b) separating said fine fraction of solids from said coarse fraction, (c) whereby said fine fraction predominates in said barium sulfate and said radioactive contamination, and (d) whereby said coarse fraction predominates in gypsum of reduced radioactive contamination.

In a preferred embodiment, the acid slurry is cooled, the acid is separated from the solid component, and the solid component is washed with water prior to separating the fine fraction from the coarse fraction, as described more fully below.

More in detail, waste product gypsum produced by the digestion of phosphate rock with aqueous sulfuric acid is purified in accordance with the process of this invention. The details for preparing such waste product gypsum are well documented in the prior art. Waste product gypsum freshly prepared in a conventional fertilizer process or waste product gypsum which has been stored in conventional gypsum waste piles, may be purified in accordance with the process of this invention. As indicated in the above-mentioned British Pat. No. 1,394,734, the radioactive contamination predominates in the −160 micron fraction. It will be recognized by those skilled in the art that the composition of the waste product gypsum and the distribution of the radioactive contaminants will vary, and will depend upon the source of the phosphate rock, the source of the waste product gypsum and the specific process for preparing it.

In the first step for purifying the waste product gypsum in accordance with the process of this invention, a dilute sulfuric acid is used to digest the gypsum. Generally, an aqueous sulfuric acid having a concentration in the range from about 10 to about 50 percent $H_2SO_4$ by weight is employed. It is preferred to employ an acid having a sulfuric acid concentration in the range from about 15 percent to about 35 percent sulfuric acid by weight. However, more dilute or concentrated solutions may be employed if desired.

Sufficient barium sulfate is added to the slurry of gypsum and sulfuric acid to provide a barium sulfate concentration in the resulting slurry in the range of from about 0.01 to about 1.0 percent by weight and preferably from about 0.03 to about 0.3 percent by weight. Excess barium sulfate may be employed, but it is generally unnecessary since such an excess adds to the cost of carrying out the process without significantly improving the reduction of radioactive contamination. Barium sulfate is preferably added as a concentrated sulfuric acid solution containing from about 0.10 to about 10 percent by weight of barium sulfate. The concentrated sulfuric acid contains from about 90 to about 100 percent by weight of sulfuric acid. Fuming sulfuric acid may be employed to dissolve the barium sulfate, if desired. The concentration of the sulfuric acid used to dissolve the barium sulfate should not be less than about 90 percent by weight, since precipitation of the barium sulfate may occur, which will increase the time of reaction and thereby reduce the efficiency of the process. If desired, solid finely divided particles of barium sulfate may be added to the acid slurry of gypsum, but this procedure will unduly extend the reaction time. In another embodiment, more expensive barium sulfate may be formed in situ by adding a reactant such as barium chloride to the dilute acid slurry.

The proportion of gypsum, in terms of anhydrous calcium sulfate, in the aqueous slurry of sulfuric acid and barium sulfate generally ranges from about 50 to about 500 grams per liter, and preferably from about 150 to about 350 grams per liter.

The resulting aqueous slurry of gypsum, sulfuric acid and barium sulfate is heated to an elevated temperature, generally to at least about 60° C., and preferably to a temperature in the range from about 80° C. to the boiling point. If desired, super atmospheric pressures may be employed. In a preferred embodiment of the invention, the barium sulfate is added to the slurry after the temperature has been raised to within the above-identified range in order to take advantage of superior absorptive properties of freshly precipitated barium sulfate. After the desired elevated temperature is obtained, the slurry is agitated for a sufficient period to effect solubilization of the radioactive contaminants, followed by absorption and/or co-precipitation of radium sulfate crystals with barium sulfate crystals in finely divided form. Generally, this digestion period ranges from about 1 to about 2000 minutes, and preferably from about 5 to about 250 minutes.

After the reaction of the acid slurry has been completed, the slurry is preferably cooled, generally to a temperature below about 60° C., and preferably in the range from about 15 to about 40° C. If desired, the hot acid slurry may be washed without a separate cooling step. The acid slurry with or without prior cooling is subjected to a solid-liquid separation step, such as filtration or cyclone separation, and the clarified acid is recovered. It may be recycled, after reconstitution, for use in reacting with additional impure waste product gypsum or used in other parts of the fertilizer process.

Details of the reaction which occur during digestion have not been positively identified, but it is believed that during the acid digestion, the radioactive components in the waste product gypsum are leached from the coarse gypsum crystals by the sulfuric acid and barium sulfate and, either during the reaction or subsequently, are absorbed or co-precipitated with the barium sulfate crystals in finely divided form. As a result, the solid product from the acid digestion is comprised of a coarse fraction of gypsum of reduced radioactive contamination and a fine fraction comprised of barium sulfate crystals and radium sulfate crystals.

The solid component of the acid slurry, after separation of the clarified acid, is then washed, for example, by slurrying water and subjected to a solids separation step wherein the coarse fraction of purified gypsum crystals are separated from the fine fraction of crystals of barium sulfate and radium sulfate. This solid separation step is preferably carried out by wet screening, but can also be accomplished in a cyclone separation apparatus or other suitable size classification techniques known in the art. If desired, the solids from the acid digestion step may be washed and dried and stored prior to the solids separation step.

Generally, the separation of the fine fraction and the coarse fraction is made at a size of at least about 150 microns, and preferably at about 80 microns. The fine fraction is generally less than −150 microns, preferably less than −80 microns and more preferably less than −50 microns to achieve the improved results of the process of this invention.

As shown in British Pat. No. 1,394,734, radioactive concentration of the fine fraction of waste product gypsum is as high as 21.5 pico Curies per gram. Another analysis of a typical waste product gypsum was found to be as follows:

| Screen Size | Weight Percent | Radium Content, pico Curies per gram |
|---|---|---|
| −30 +50 mesh | 1.2 | — |
| −50 +100 | 21.0 | 6.91 |
| −100 +200 | 31.6 | 20.7 |
| −200 +325 | 12.2 | 10.7 |
| −325 | 34.0 | 29.5 |

In contrast, the improved process of this invention produces a purified waste product gypsum in which the radioactive contamination has been reduced as low as 1.5 pico Curies per gram, which renders the purified gypsum suitable for use as a component of wallboard and other construction materials useful in the preparation of homes, buildings and the like.

In another embodiment of the invention, the reacted acid slurry, with or without washing of the solid component, may be processed to separate the fine fraction from the coarse fraction.

The following examples are presented to illustrate the invention without being limited thereby. All parts are by weight unless otherwise specified.

EXAMPLE 1

An aqueous sulfuric acid solution (2.97 liters) having a concentration of 28 percent was admixed with a concentrated sulfuric acid solution (30 milliliters) containing dissolved therein 3 grams of barium sulfate at a temperature of 105° C. Waste product phosphogypsum from a wet process phosphoric acid plant (750 grams containing a radium concentration of 26 pico Curies per gram) was agitated with the solution of sulfuric acid and barium sulfate for a period of 12 minutes, while maintaining the temperature of the resulting slurry in the range of 98°-105° C.

At the end of this period, the slurry was cooled at a temperature of 30°-35° C. and then filtered. The filter cake was washed with 6.2 liters of water and the solids were dried at a temperature of 60° C. The weight of the dry solids was 695 grams.

50 Grams of the dried solids was slurried with 1 liter of water and then wet screened on a 200 mesh (74 micron) screen. The solid gypsum material retained on the 200 mesh screen was collected and dried at 60° C. Analysis of the purified gypsum product showed that it had a radium concentration of 1.42 pico Curies per gram. This purified gypsum material was suitable for use in preparing plaster, gypsum wallboards, and other construction materials.

EXAMPLE 2

A procedure similar to Example 1 was employed except that the solution of barium sulfate in sulfuric acid contained 1.5 grams of barium sulfate dissolved in 15 milliliters of sulfuric acid. Analysis of the washed screened purified gypsum product showed that it had a radium concentration of 5.8 Curies per gram.

What is to be secured by letters patent is:

1. A process for reducing the radioactive contamination in waste product gypsum which comprises:
   (a) admixing waste product gypsum containing radioactive contamination with dilute sulfuric acid containing barium sulfate at an elevated temperature to form an acid slurry having a solid component comprised of a fine fraction and a coarse fraction, and
   (b) separating said fine fraction of solids from said coarse fraction,
   (c) whereby said fine fraction predominates in said barium sulfate and said radioactive contamination, and
   (d) whereby said coarse fraction predominates in gypsum of reduced radioactive contamination.

2. The process of claim 1 wherein said solid component is separated from said acid slurry and washed with water prior to separating said fine fraction from said coarse fraction.

3. The process of claim 2 wherein said acid slurry is admixed at a temperature above 60° C.

4. The process of claim 3 wherein said acid slurry is admixed at a temperature in the range of about 80° C. to the boiling point.

5. The process of claim 3 wherein said acid slurry is cooled to a temperature below about 60° C. before separating said acid from said solid component.

6. The process of claim 4 wherein said acid slurry is cooled to a temperature in the range of from about 15°–40° C. prior to separating said acid from said solid component.

7. The process of claim 2 wherein said fine fraction is less than about 150 microns.

8. The process of claim 3 wherein said fine fraction is less than about 80 microns.

9. The process of claim 6 wherein said fine fraction is less than about 80 microns.

10. The process of claim 3 wherein the proportion of said barium sulfate in said acid slurry ranges from about 0.01 to about 1.0 percent by weight.

11. The process of claim 8 wherein the proportion of said barium sulfate in said acid slurry ranges from about 0.03 to about 0.3 percent by weight.

12. The process of claim 3 wherein the concentration of said dilute sulfuric acid used to form said acid slurry ranges from about 10 to about 50 percent by weight of $H_2SO_4$.

13. The process of claim 11 wherein the concentration of said dilute sulfuric acid used to form said acid slurry ranges from about 15 to about 35 percent by weight of sulfuric acid.

14. The process of claim 3 wherein the concentration of said waste product gypsum added to said acid slurry, based upon anhydrous calcium sulfate equivalent, is in the range from about 50 to about 500 grams per liter of acid solution.

15. The process of claim 13 wherein the concentration of waste product gypsum added to said acid slurry, based upon anhydrous calcium sulfate equivalent, is in the range from about 150–350 grams per liter of acid solution.

16. The process of claim 15 wherein said fine fraction is separated from said coarse fraction by screening.

17. The process of claim 15 wherein said fine fraction is separated from said coarse fraction in an aqueous suspension in a hydrocyclone.

18. The process of claim 4 wherein said solid component, after admixing with water for washing, is dewatered and dried prior to separating said fine fraction from said coarse fraction.

* * * * *